US010868360B2

(12) United States Patent
Lu et al.

(10) Patent No.: US 10,868,360 B2
(45) Date of Patent: Dec. 15, 2020

(54) ANTENNA STRUCTURE AND MANUFACTURE METHOD THEREOF, COMMUNICATION DEVICE

(71) Applicant: BOE TECHNOLOGY GROUP CO., LTD., Beijing (CN)

(72) Inventors: Yongchun Lu, Beijing (CN); Xinyin Wu, Beijing (CN); Hongfei Cheng, Beijing (CN); Chunping Long, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 161 days.

(21) Appl. No.: 15/864,306

(22) Filed: Jan. 8, 2018

(65) Prior Publication Data

US 2018/0294556 A1 Oct. 11, 2018

(30) Foreign Application Priority Data

Apr. 6, 2017 (CN) ..... 2017 1 0221891

(51) Int. Cl.
*H01Q 1/36* (2006.01)
*H01Q 3/26* (2006.01)
*H01Q 1/38* (2006.01)

(52) U.S. Cl.
CPC ..... *H01Q 1/36* (2013.01); *H01Q 1/38* (2013.01); *H01Q 3/26* (2013.01)

(58) Field of Classification Search
CPC ..... H01L 51/0076; H01Q 13/28; H01Q 15/10
See application file for complete search history.

(56) References Cited

U.S. PATENT DOCUMENTS

2005/0128386 A1 6/2005 Nakayoshi et al.
2006/0099738 A1* 5/2006 Yamazaki ..... H01L 21/486 438/114

(Continued)

FOREIGN PATENT DOCUMENTS

CN 1410802 A 4/2003
CN 101133434 A 2/2008

(Continued)

OTHER PUBLICATIONS

Chinese Office Action in Chinese Application No. 201710221891.7, dated Dec. 20, 2018 with English translation.

*Primary Examiner* — Ricardo I Magallanes
(74) *Attorney, Agent, or Firm* — Collard & Roe, P.C.

(57) ABSTRACT

An antenna structure, a manufacturing method thereof, and a communication device are disclosed. The antenna structure includes a first substrate, a second substrate, a dielectric layer, a plurality of first electrodes and a plurality of second electrodes. The dielectric layer is disposed between the first substrate and the second substrate; the plurality of first electrodes are disposed at intervals on a side of the first substrate adjacent to the dielectric layer; the plurality of second electrodes are disposed at intervals on a side of the second substrate adjacent to the dielectric layer; a side of the first substrate facing the second substrate includes a plurality of first recess portions each including a first concaved surface which is dented into the first substrate; the dielectric layer is at least partly disposed in the plurality of first recess portions.

11 Claims, 2 Drawing Sheets

(56) References Cited

U.S. PATENT DOCUMENTS

| | | | | |
|---|---|---|---|---|
| 2006/0227283 | A1* | 10/2006 | Ooi | G02F 1/13306 349/201 |
| 2008/0055831 | A1 | 3/2008 | Satoh | |
| 2009/0103032 | A1* | 4/2009 | Liao | G02F 1/1395 349/138 |
| 2012/0092577 | A1 | 4/2012 | Shi et al. | |
| 2013/0176522 | A1 | 6/2013 | Wu et al. | |
| 2019/0148838 | A1* | 5/2019 | Ohtake | H01Q 13/10 343/720 |
| 2019/0265524 | A1* | 8/2019 | Asagi | G02F 1/1368 |

FOREIGN PATENT DOCUMENTS

| | | | |
|---|---|---|---|
| CN | 101728327 | A | 6/2010 |
| CN | 101930134 | A | 12/2010 |
| CN | 106299627 | A | 1/2017 |
| TW | 200919006 | A | 5/2009 |

* cited by examiner

ANTENNA STRUCTURE AND MANUFACTURE METHOD THEREOF, COMMUNICATION DEVICE

CROSS REFERENCE TO RELATED APPLICATIONS

Applicant claims priority under 35 U.S.C. § 119 of Chinese Application No. CN 201710221891.7 filed on Apr. 6, 2017, the disclosure of which is incorporated by reference.

The present application claims priority to the Chinese patent application No. 201710221891.7 titled "ANTENNA STRUCTURE AND MANUFACTURE METHOD THEREOF, COMMUNICATION DEVICE" filed Apr. 6, 2017, the entire disclosure of which is incorporated herein by reference as part of the present application.

TECHNICAL FIELD

Embodiments of the present disclosure relate to an antenna structure, a manufacturing method thereof and a communication device.

BACKGROUND

With continuous developments of communication technologies, antennas have been developed towards smaller size, broadband, multiband and high gain. As compared with conventional antennas such as horn antenna, helical antenna and dipole antenna, liquid crystal (LC) antenna has become the one most adaptable for current development direction of technology.

Generally, the LC antenna includes a transmitter patch, a grounding electrode and liquid crystals (LCs) located between the transmitter patch and the grounding electrode. When flowing into the LC antenna, an electromagnetic wave having a certain frequency may radiate outwards through the LC antenna in case that the certain frequency is consistent with a resonant frequency of the LC antenna, or may not radiate outwards through the LC antenna in case that the certain frequency is inconsistent with the resonant frequency. Furthermore, a change in an orientation of LCs would lead to a difference in an effective dielectric constant, and hence result in a change of capacitance. Therefore, the orientation of LCs between the transmitter patch and the grounding electrode may be adjustable by applying a voltage to the transmitter patch, so as to adjust the resonant frequency of the LC antenna.

SUMMARY

At least one embodiment of the present disclosure provides an antenna structure, a manufacturing method thereof, and a communication device.

At least one embodiment of the present disclosure provides an antenna structure, including a first substrate; a second substrate; a dielectric layer disposed between the first substrate and the second substrate; a plurality of first electrodes disposed at intervals on a side of the first substrate adjacent to the dielectric layer; and a plurality of second electrodes disposed at intervals on a side of the second substrate adjacent to the dielectric layer. A side of the first substrate facing the second substrate includes a plurality of first recess portions each including a first concaved surface which is dented into the first substrate. The dielectric layer is at least partly disposed in the plurality of first recess portions.

For example, the plurality of first electrodes are disposed in one-to-one correspondence with the plurality of first recess portions, and each of the plurality of first electrodes is disposed on the first concaved surface of a corresponding first recess portion.

For example, a cross section of the first recess portion includes a semi-circular shape.

For example, a side of the second substrate facing the first substrate includes a plurality of second recess portions each including a second concaved surface which is dented into the second substrate, and the dielectric layer is at least partly disposed in the plurality of second recess portions.

For example, the plurality of second recess portions are disposed in one-to-one correspondence with the plurality of first recess portions.

For example, the first substrate further includes a plurality of first flat portions each connecting adjacent first recess portions, and the first flat portions and the second substrate are configured to seal the plurality of first recess portions.

For example, the first substrate further includes a plurality of first flat portions each connecting adjacent first recess portions, the second substrate further includes a plurality of second flat portions each connecting adjacent second recess portions, and the plurality of first flat portions and the plurality of second flat portions are configured to seal the plurality of first recess portions and the plurality of second recess portions, respectively.

For example, the antenna structure further includes a plurality of buffer blocks disposed between the first flat portions and the second substrate.

For example, the plurality of second electrodes are disposed in one-to-one correspondence with the plurality of second flat portions, and each of the plurality of second electrodes is disposed on a corresponding second flat portion.

For example, an orthographic projection of the second concaved surface on the first substrate is fallen within an orthographic projection of the first concaved surface on the first substrate.

For example, a cross section of the second concaved surface includes a semi-circular shape.

For example, the dielectric layer includes liquid crystals (LCs).

For example, each of the first substrate and the second substrate is a flexible substrate.

For example, the antenna structure further includes: a first control electrode which is disposed between the first substrate and the first electrode and is electrically connected to the first electrode; and a second control electrode, which is disposed between the second substrate and the second electrode, and is electrically connected to the second electrode.

At least one embodiment of the present disclosure provides a manufacturing method of an antenna structure, including: providing a first substrate and a second substrate; forming a plurality of first recess portions in the first substrate; forming a plurality of first electrodes at intervals on a side of the first substrate on which the plurality of first recess portions are formed; forming a plurality of second electrodes at intervals on the second substrate; and disposing the first substrate and the second substrate to be opposite to each other and disposing a dielectric layer between the first substrate and the second substrate in such a manner that the side of the first substrate on which the plurality of first electrodes are formed is opposite to the side of the second substrate on which the plurality of second electrodes are formed, and the dielectric layer is partly filled in the plurality of first recess portions.

At least one embodiment of the present disclosure provides a communication device including any of the above-mentioned antenna structures.

BRIEF DESCRIPTION OF THE DRAWINGS

Hereafter, the embodiments of the present invention will be described in detail with reference to the drawings, so as to make one person skilled in the art understand the present invention more clearly.

DETAILED DESCRIPTION

Hereafter, the technical solutions in the embodiments of the present disclosure will be clearly, completely described with reference to the drawings in the embodiments of the present disclosure. Obviously, the embodiments described are only a part of the embodiments, not all embodiments. Based on the embodiments in the present disclosure, all other embodiments obtained by one skilled in the art without paying inventive labor are within the protection scope of the present disclosure.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
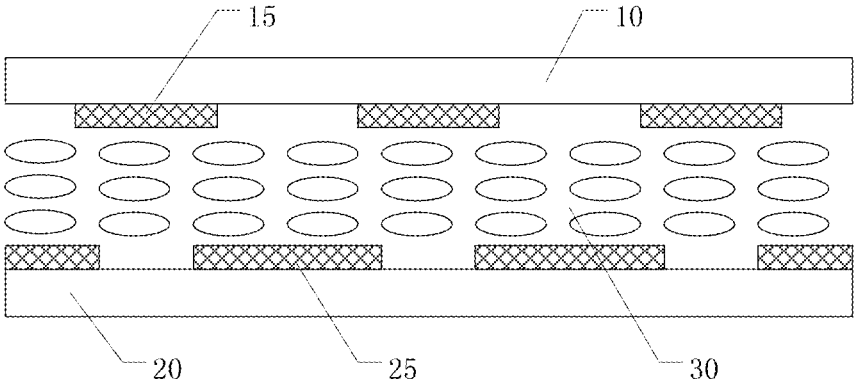
FIG. 1 is a schematic cross-sectional view of a LC antenna.
Figure 2:
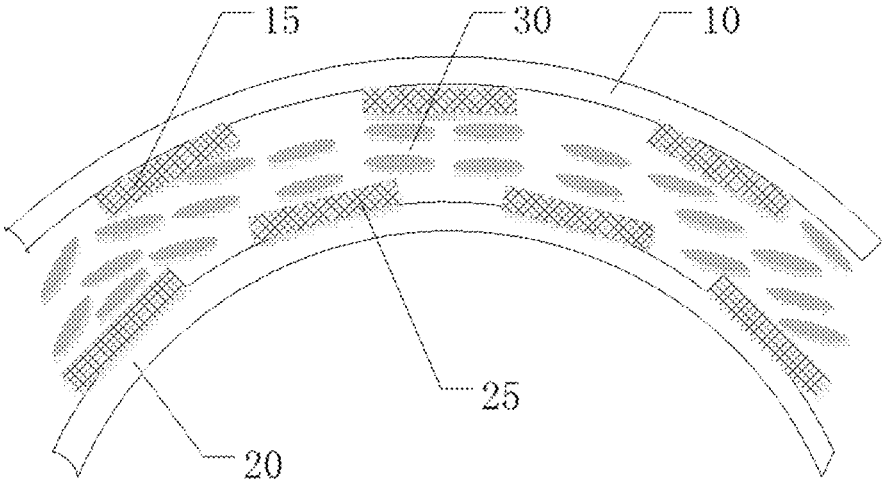
FIG. 2 is a schematic view illustrating a LC antenna having been curved.

During research, the inventors of the present application noticed that, customers have proposed relatively higher requirements on wearable intelligent products having powerful functions such as physical index monitoring, GPS and 4G or 5G mobile network, with the continuous development of communication technology and communication device. However, the wearable intelligent product will inevitably be curved or bent during practical usage; therefore antennas in the wearable intelligent product may, more or less, need to be flexible. FIG. 1 illustrates a schematic structural view of a LC antenna. As illustrated in FIG. 1, the antenna structure includes a first substrate 10, a second substrate 20, a LC layer 30 disposed between the first substrate 10 and the second substrate 20, a plurality of first electrodes 15 disposed on a side of the first substrate 10 adjacent to the LC layer 30, and a plurality of second electrodes 25 disposed on a side of the second substrate 20 adjacent to the LC layer 30. FIG. 2 is a schematic view illustrating a LC antenna having been curved. As illustrated in FIG. 2, the LC antenna in a curved state is subjected to a force which varies depending on a location in such a manner that the location with larger curvature is subjected to a larger force; as a result, LC materials at different locations of the LC antenna will be flowing under extrusion and ultimately lead to uneven thickness at different locations of the LC layer 30, which may affect a transmission path and a transmission speed of antenna signals.

The embodiment of the present disclosure provides an antenna structure, a manufacturing method thereof and a communication device. The antenna structure includes a first substrate, a second substrate, a dielectric layer, a plurality of first electrodes and a plurality of second electrodes. The dielectric layer is disposed between the first substrate and the second substrate; the plurality of first electrodes are disposed at intervals on a side of the first substrate adjacent to the dielectric layer; the plurality of second electrodes are disposed at intervals on a side of the second substrate adjacent to the dielectric layer; a side of the first substrate facing the second substrate includes a plurality of first recess portions each including a first concaved surface dented into the first substrate; the dielectric layer is partly disposed in the plurality of first recess portions. In this way, the antenna structure can limit a flowing movement of the dielectric layer by the plurality of first recess portions disposed on the first substrate, so as to prevent the dielectric layer from flowing and leading to uneven thickness thereof when the antenna structure is curved or bent, thereby avoiding various defects of the antenna structure due to uneven thickness of the dielectric layer.

Hereinafter the antenna structure, the manufacturing method thereof and the communication device provided by the embodiments of the present disclosure will be described in conjunction with the drawings.

Figure 3:
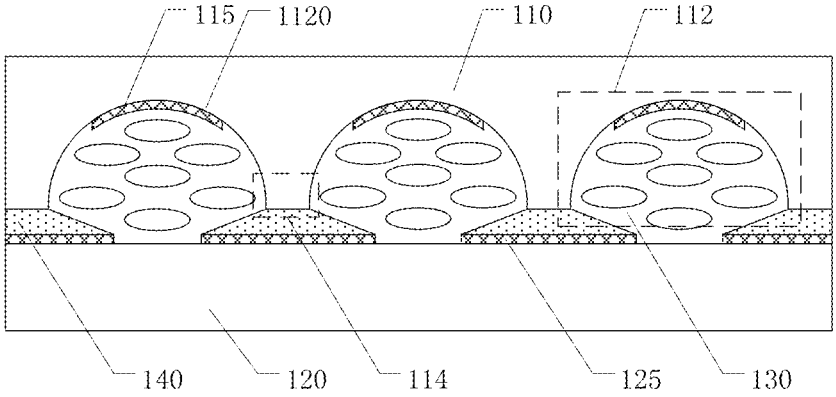
FIG. 3 is a schematic cross-sectional view of an antenna structure provided by an embodiment of the present disclosure.

An embodiment of the present disclosure provides an antenna structure. FIG. 3 illustrates an antenna structure provided by the present embodiment. As illustrated in FIG. 3, the antenna structure includes a first substrate 110, a second substrate 120, a dielectric layer 130, a plurality of first electrodes 115 and a plurality of second electrodes 125. The dielectric layer 130 is disposed between the first substrate 110 and the second substrate 120; the plurality of first electrodes 115 are disposed at intervals on a side of the first substrate 110 adjacent to the dielectric layer 130; the plurality of second electrodes 125 are disposed at intervals on a side of the second substrate 120 adjacent to the dielectric layer 130; a side of the first substrate 110 facing the second substrate 120 includes a plurality of first recess portions 112 each including a first concaved surface 1120 dented into the first substrate 110; the dielectric layer 130 is at least partly disposed in the plurality of first recess portions 112. It should be explained that, the dielectric layer being at least partly disposed in the plurality of first recess portions refers to that: the dielectric layer may be completely disposed in the plurality of first recess portions, or may be partly disposed in the first recess portions and partly disposed outside the first recess portions.

In the antenna structure provided by the present embodiment, the first substrate includes a plurality of first recess portions formed into accommodation spaces in which the dielectric layer may be disposed. In this way, side walls of the first recess portions may serve to restrict the dielectric layer in the accommodation space to a certain degree, so as to prevent the dielectric layer from flowing. In this way, the antenna structure can limit a flowing movement of the dielectric layer by the plurality of first recess portions disposed on the first substrate, so as to prevent the dielectric layer from flowing and leading to uneven thickness thereof when the antenna structure is curved or bent, thereby avoiding various defects of the antenna structure due to uneven thickness of the dielectric layer. Moreover, the abovementioned antenna structure has no need of additionally disposing a component for blocking the flowing of the dielectric layer, and hence is advantageous in simpler structure, smaller size and weight, and the like.

For example, in the antenna structure provided by an example of the present embodiment, the dielectric layer may include liquid crystals (LCs). In this way, an orientation of LC molecules in the dielectric layer located between the first substrate and the second substrate may be changed by changing an electric field applied between the first electrodes and the second electrodes, so as to adjust a resonant frequency of the antenna structure, thereby increasing a frequency band of the electromagnetic wave which is receivable or transmittable by the antenna structure.

For example, in the antenna structure provided by an example of the present embodiment, each of the first substrate and the second substrate may be a flexible substrate. In this way, the antenna structure may be applied in a flexible electronic device, for example, a wearable intelligent product having powerful functions such as physical index monitoring, GPS and 4G or 5G mobile network.

For example, the first substrate and the second substrate may adopt a polymer substrate or a metallic substrate with excellent ductility.

For example, in the antenna structure provided by an example of the present embodiment, as illustrated in FIG. 3, portions on the first substrate 110 having not been disposed with the first recess 112, that is, first flat portions between adjacent first recess portions 112 may, together with the second substrate 120, seal the plurality of first recess portions 112; for example, the first flat portions 114 are contacted with the second substrate 120 so that the dielectric layer 130 (e.g., LCs) is completely disposed in the accommodation spaces constituted by the first recess portions 112 and the second substrate 120, that is, the dielectric layer 130 (e.g., LCs) is completely disposed in the plurality of first recess portions 112. In this way, the first recess portions can perfectly prevent the dielectric layer from flowing, and hence prevent the dielectric layer from flowing and leading to uneven thickness thereof when the antenna structure is curved or bent, so as to avoid various defects of the antenna structure due to uneven thickness of the dielectric layer. Of course, the embodiments of the present disclosure are not limited thereto, and the first recess portions may not be sealed.

For example, in the antenna structure provided by an example of the present embodiment, as illustrated in FIG. 3, the plurality of first electrodes 115 are disposed in one-to-one correspondence with the plurality of first recess portions 112, and each of the plurality of first electrodes 115 is disposed on a first concaved surface 1120 of a corresponding first recess portion 112. The first concaved surface 1120 is right opposite to the dielectric layer 130, thus the first electrode 115 disposed on the first concaved surface 1120 may control the dielectric layer 130 in a better way, which improves a control accuracy and hence increases an accuracy of the antenna structure.

For example, in the antenna structure provided by an example of the present embodiment, as illustrated in FIG. 3, a shape of a cross section of the first recess portion 112 includes semi-circular shape. Thus, a portion of the dielectric layer (e.g., LCs) disposed in the first recess portion 112 may have a shape of convex lens, so as to converge the electromagnetic wave to a certain degree, thereby serving to reduce a main lobe width of the electromagnetic wave. In this way, the antenna structure enables better directivity and sensitivity of the electromagnetic wave. In other words, the antenna structure possesses stronger capability of receiving and emitting electromagnetic wave in a designated direction. It should be explained that, when the first recess portion has a semi-cylinder shape, the abovementioned cross section includes a section taken along a surface perpendicular to an extension direction of the first recess portion; when the first recess portion has a hemisphere shape, the abovementioned cross section includes a section taken along a surface which is passing through a vertex of the first recess portion and is parallel to a surface of the first substrate. In addition, when the cross section of the first recess portion includes a semi-circular shape, a line of the first concaved surface, along which the abovementioned cross section is taken, is a first arc line. Of course, the embodiments of the present disclosure are not limited thereto, and the cross section of the first recess portion may have other shapes.

For example, in the antenna structure provided by an example of the present embodiment, as illustrated in FIG. 3, the antenna structure further includes a plurality of buffer blocks 140 disposed between the first flat portions 114 and the second substrate 120. In this way, on one aspect the plurality of buffer blocks 140 can increase a bonding force between the first flat portions 114 and the second substrate 120; on the other aspect the plurality of buffer blocks 140 can buffer an external force subjected by the antenna structure.

For example, in the antenna structure provided by an example of the present embodiment, as illustrated in FIG. 3, the plurality of second electrodes 125 are disposed in one-to-one correspondence with the plurality of buffer blocks 140. In this way, the plurality of buffer blocks further serve to prevent the second electrodes from separating when the antenna structure is curved or bent.

For example, a material of the buffer block may have a viscosity larger than that of a material of the second substrate. In this way, the buffer block can increase the bonding force between the second electrode and the buffer block by adopting a material having higher viscosity, so as to further prevent the second electrode from breaking off or separating from the second substrate when the antenna structure is curved or bent. For example, the material of the first and the second buffer block has a viscosity larger than 1000 Pa·s.

For example, the material of the buffer block includes polydimethylsiloxane (PDMS). The PDMS has not only lower elasticity modulus but also higher viscosity, so as to increase the bonding force between the second electrode and the buffer block, and also to well buffer the external force which may result in curving or bending. Additionally, the PDMS barely hinders the electromagnetic wave, and will not affect the transmission of the signals of the antenna structure.

Figure 4:
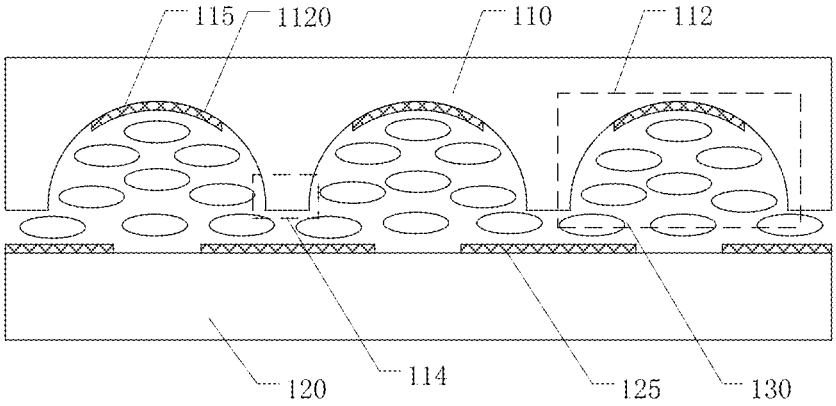
FIG. 4 is a schematic cross-sectional view of another antenna structure provided by an embodiment of the present disclosure.

Another embodiment of the present disclosure provides an antenna structure. FIG. 4 illustrates a schematic diagram of the antenna structure according to the present embodiment. Differently from the embodiment of FIG. 3, as illustrated in FIG. 4, in the antenna structure, portions on the first substrate 110 having not been disposed with the first recess portions 112, that is, the first flat portions 114 between adjacent first recess portions 112, may not be sealed with the second substrate 120. In other words, the dielectric layer 130 further includes portions located between the first flat portions 114 and the second substrate 120. Although the dielectric layer 130 (e.g., LCs) between the first flat portions 114 and the second substrate 120 may flow, the side walls of the first recess portions 112 still can serve to prevent the dielectric layer from flowing because a part of the dielectric layer 130 still is disposed in the first recess portion 112, so as to prevent the dielectric layer from flowing and leading to uneven thickness thereof when the antenna structure is curved or bent, thereby avoiding various defects of the antenna structure due to the uneven thickness of the dielectric layer.

Figure 5:
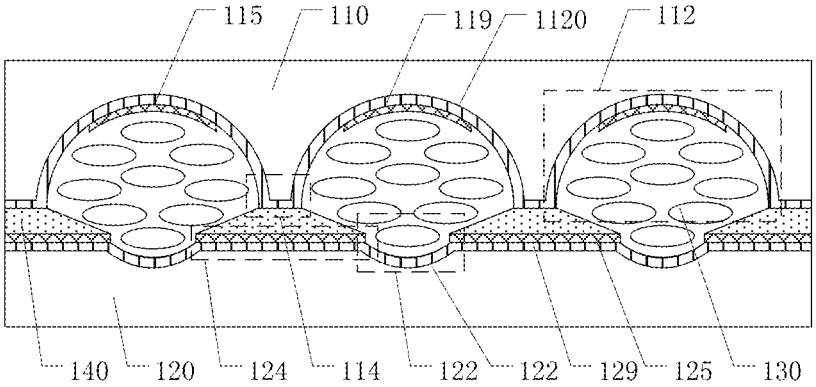
FIG. 5 is a schematic cross-sectional view of yet another antenna structure provided by an embodiment of the present disclosure.

On the basis of the embodiment illustrated in FIG. 3, yet another embodiment of the present disclosure provides an antenna structure. FIG. 5 illustrates a schematic diagram of the antenna structure according to the present embodiment. As illustrated in FIG. 5, in the antenna structure, a side of the second substrate 120 facing the first substrate 110 includes a plurality of second recess portions 122 each including a second concaved surface 1220 dented into the second substrate 120. The dielectric layer 130 (e.g., LCs) is further partly disposed in the plurality of second recess portions 122.

In the antenna structure provided by the present embodiment, the second substrate includes a plurality of second recess portions formed into accommodation spaces in which the dielectric layer (e.g., LCs) is further disposed. In this way, side walls of the second recess portions may also serve to restrict the dielectric layer in the accommodation space to a certain degree, so as to prevent the dielectric layer from flowing. In this way, the antenna structure can further limit the flowing of the dielectric layer by the plurality of second recess portions disposed on the second substrate, so as to prevent the dielectric layer from flowing and leading to uneven thickness thereof when the antenna structure is curved or bent, thereby avoiding various defects of the antenna structure due to the uneven thickness of the dielectric layer. In addition, when the antenna structure is subjected to an excessively larger external force, the second recess portion also serves to provide a buffering space for the dielectric layer to prevent the LCs from impacting a bonding portion between the first substrate and the second substrate due to the excessively larger external force which may affect a sealing effect of the device.

For example, in the antenna structure provided by an example of the present embodiment, as illustrated in FIG. 5, the plurality of second recess portions 122 are disposed in one-to-one correspondence with the plurality of first recess portions 112. In this way, each of the first recess portions forms an accommodation space with a corresponding second recess portion. The dielectric layer (e.g., LCs) may be disposed in the accommodation space. In addition, the first recess portion and the second recess portion that are disposed to be corresponding to each other may increase a thickness of the dielectric layer in a direction perpendicular to the first substrate, thereby improving a tuning effect of the antenna structure.

For example, in the antenna structure provided by an example of the present embodiment, as illustrated in FIG. 5, a cross section of each of the second recess portions may include a semi-circular shape. Thus, the portion of the dielectric layer (e.g., LCs) disposed in each of the second recess portions may have a shape of convex lens, so as to converge the electromagnetic wave to a certain degree, thereby serving to reduce a main lobe width of the electromagnetic wave. When the cross section of the second recess portion includes a semi-circular shape, a line of the second concaved surface, along which the abovementioned cross section is taken, is a second arc line. Of course, the embodiments of the present disclosure are not limited thereto, and the cross section of the second recess portion may have other shapes.

For example, in the antenna structure provided by an example of the present embodiment, as illustrated in FIG. 5, a radian of the second arc line is smaller than a radian of the first arc line. In this way, when the dielectric layer (e.g., LCs) is filled between the first substrate and the second substrate, it may be possible to firstly fill an excessive amount of dielectric layer into the first recess portions and then bond the first substrate with the second substrate so that the second recess portions are also filled with the dielectric layer. In this way, the radian of the second arc line is smaller than the radian of the first arc line, which reduces the difficulty in filling the dielectric layer in the antenna structure.

For example, in the antenna structure provided by an example of the present embodiment, as illustrated in FIG. 5, the first substrate 110 includes a plurality of first flat portions 114 each connecting adjacent first recess portions 112; the second substrate 120 further includes a plurality of second flat portions 124 each connecting adjacent second recess portions 122; the plurality of first flat portions 114 and the plurality of second flat portions 124 may seal the plurality of first recess portions 112 and the plurality of second recess portions 122, respectively, so that the dielectric layer 130 (e.g., LCs) is completely disposed in the accommodation spaces constituted by the first recess portions 112 and the second recess portions 122, that is, the dielectric layer 130 (e.g., LCs) is completely disposed in the plurality of first recess portions 112 and the plurality of second recess portions 122. In this way, the first recess portions and the second recess portions may perfectly prevent the dielectric layer from flowing, so as to further prevent the dielectric layer from flowing and leading to uneven thickness thereof when the antenna structure is curved or bent, thereby avoiding various defects of the antenna structure due to the uneven thickness of the dielectric layer.

For example, in the antenna structure provided by an example of the present embodiment, as illustrated in FIG. 5, the plurality of first flat portions 114 are disposed in one-to-one correspondence with the plurality of second flat portions 124. The antenna structure further includes a plurality of buffer blocks 140 disposed between the first flat portions 114 and the second flat portions 124. It should be explained that, it may be possible to dispose only one buffer block or several buffer blocks between the first flat portion and the corresponding second flat portion. In this way, on one aspect the buffer block can increase a bonding force between the first flat portion and the second flat portion; and on the other aspect the buffer block can buffer an external force subjected by the antenna structure.

For example, in the antenna structure provided by an example of the present embodiment, as illustrated in FIG. 5, the plurality of second electrodes 125 are disposed in one-to-one correspondence with the plurality of second flat portions 124, and are disposed on the plurality of second flat portions 124. In this way, orthographic projections of the plurality of first electrodes are alternated with orthographic projections of the plurality of second electrodes on the first substrate. The electric field formed by the first electrodes and the second electrodes is not perpendicular to the first substrate but has a certain degree with respect to the first substrate. In this way, it can reduce the thickness of the dielectric layer while ensuring the tuning effect of the antenna structure, or improve the tuning effect of the antenna structure while maintaining the thickness of the dielectric layer.

For example, in the antenna structure provided by an example of the present embodiment, as illustrated in FIG. 5, the plurality of second electrodes 125 are also disposed in one-to-one correspondence with the plurality of buffer blocks 140. In this way, the buffer block may also serve to prevent the second electrodes from separating when the antenna structure is curved or bent.

For example, in the antenna structure provided by an example of the present embodiment, as illustrated in FIG. 5, an orthographic projection of the second concaved surface 1220 on the first substrate 110 is fallen with an orthographic projection of the first concaved surface 1120 on the first substrate. In such case, on the cross section illustrated in FIG. 5, a length of the second flat portion is longer than a length of the first flat portion. In this way, on one aspect, the relatively shorter, first flat portion can be prevented from buckling under external force, so as to prevent the second electrode from breaking off due to bending along with the first flat portion; on the other aspect, the relatively longer, second flat portion can ensure a flatness of the second electrode disposed on the second flat portion and ensure that the second electrode is unlikely to be separated from the second flat portion when the antenna structure is subjected to external force.

For example, in the antenna structure provided by an example of the present embodiment, as illustrated in FIG. 5, the antenna structure further includes a first control electrode 119 which is disposed between the first substrate 110 and the first electrode 115, and is electrically connected to the first electrode 115; and a second control electrode 129 which is disposed between the second substrate 120 and the second electrode 125, and is electrically connected to the second electrode 125. In this way, the antenna structure can apply an electric signal to the plurality of first electrodes 115 through the first control electrode 119, and apply an electric signal to the plurality of second electrodes 125 through the second control electrode 129. Of course, the embodiments of the present disclosure are not limited thereto, and the antenna structure is also possible to apply the electric signal to the first electrode or the second electrode by a plurality of wires.

For example, in the antenna structure provided by an example of the present embodiment, as illustrated in FIG. 5, the first control electrode 119 is integrally formed onto the first substrate 110, and the second control electrode 129 is integrally formed onto the second substrate 120. In this way, a total number of patterning processes may be reduced.

Figure 6:
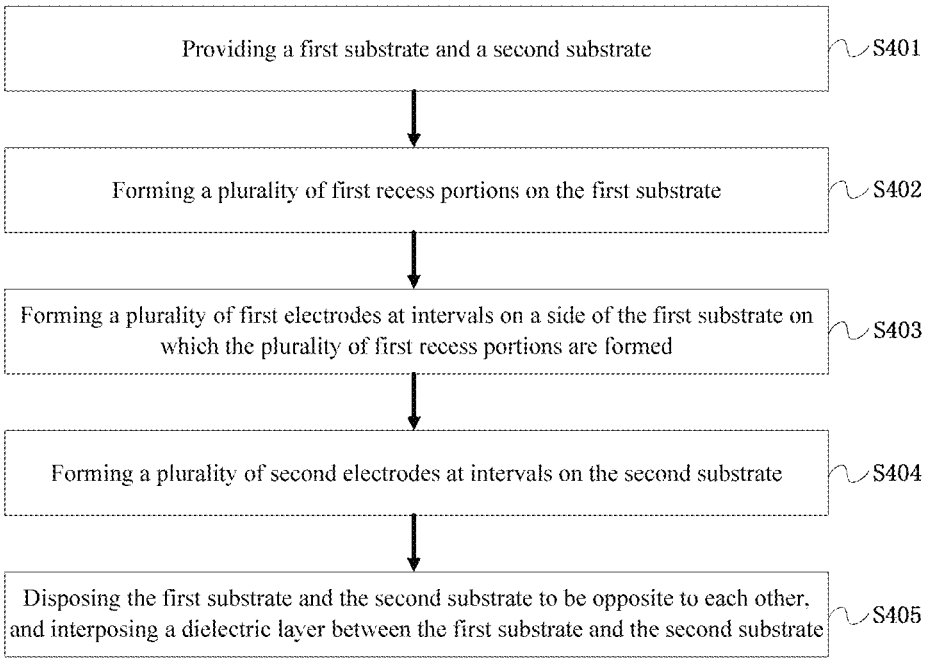
FIG. 6 is a flow chart illustrating a manufacturing method of an antennal structure provided by an embodiment of the present disclosure.

Still another embodiment of the present disclosure provides a manufacturing method of an antenna structure. FIG. 6 illustrates a manufacturing method of an antenna structure provided by the present embodiment. The manufacturing method includes steps.

Providing a first substrate and a second substrate.

Forming a plurality of first recess portions on the first substrate.

For example, it may be possible to form the plurality of first recess portions on the first substrate by an etching process.

Forming a plurality of first electrodes at intervals on a side of the first substrate on which the plurality of first recess portions are formed.

For example, it may be possible to form a film layer of first electrode on the side of the first substrate, on which the plurality of first recess portions are formed, by a film forming process such as depositing or evaporating, and to pattern the film layer of first electrode by a patterning process so as to form the plurality of first electrodes. Of course, the embodiments of the present disclosure are not limited thereto, and the plurality of first electrodes may be formed by a transfer printing process.

Forming a plurality of second electrodes at intervals on the second substrate.

For example, it may be possible to form a film layer of second electrode on the second substrate by a film forming process such as depositing or evaporating, and to pattern the film layer of second electrode by a patterning process so as to form the plurality of second electrodes. Of course, the embodiments of the present disclosure are not limited thereto, and the plurality of second electrodes may be formed by a transfer printing process.

Disposing the first substrate and the second substrate to be opposite to each other, and interposing a dielectric layer between the first substrate and the second substrate in such a manner that the side of the first substrate, on which the plurality of first electrodes are formed, is facing the side of the second substrate, on which the plurality of second electrodes are formed, and the dielectric layer is at least partly filled in the plurality of first recess portions. It should be explained that, it may be possible to firstly bond the first substrate with the second substrate and then interpose the dielectric layer there-between; or it may be possible to firstly dispose the dielectric layer in the first recess portions and then bond the first substrate with the second substrate, without particularly limited herein.

In the manufacturing method of antenna structure provided by the present embodiment, the first substrate includes a plurality of first recess portions formed into accommodation spaces in which the dielectric layer is disposed. In this way, side walls of the first recess portions may serve to restrict the dielectric layer in the accommodation spaces to a certain degree, so as to prevent the dielectric layer from flowing. In this way, the antenna structure can limit a flowing movement of the dielectric layer by the plurality of first recess portions disposed on the first substrate, so as to prevent the dielectric layer from flowing and leading to uneven thickness thereof when the antenna structure is curved or bent, thereby avoiding various defects of the antenna structure due to uneven thickness of the dielectric layer.

For example, in the antenna structure provided by an example of the present embodiment, the dielectric layer may include crystal liquids (LCs). In this way, an orientation of LC molecules in the dielectric layer located between the first substrate and the second substrate may be changed by changing an electric field applied between the first electrodes and the second electrodes, so as to adjust a resonant frequency of the antenna structure, thereby increasing a frequency band of the electromagnetic wave which is receivable or transmittable by the antenna structure.

For example, in the antenna structure provided by an example of the present embodiment, each of the first substrate and the second substrate may be a flexible substrate. In this way, the antenna structure may be applied in a flexible electronic device, for example, a wearable intelligent product having powerful functions such as physical index monitoring, GPS, and 4G or 5G mobile network.

For example, the first substrate and the second substrate may adopt a polymeric substrate or a metallic substrate with excellent ductility.

Further another embodiment of the present disclosure provides a communication device, which includes the antenna structure described in any of the embodiments illustrated in FIGS. 3-5. In this way, the communication device can also bring about the technical effects corresponding to the antenna structure contained therein. Reference may be made to the related description in the embodiments illustrated in FIGS. 3-5 without repeating herein.

For example, the communication device may be a flexible wearable device. The communication device adopts the antenna structure of any of the embodiments illustrated in FIGS. 3-5, and hence will not involve the problem of uneven dielectric layer; furthermore, the communication quality and the communication effect of the commutation device in curved or bent state can be improved. Of course, the communication device provided by the present embodiment may also be electronic devices other than flexible wearable device.

The following statements should be noted:

(1) The accompanying drawings involve only the structure(s) in connection with the embodiment(s) of the present disclosure, and other structure(s) can be referred to common design(s).

(2) For the purpose of clarity only, in accompanying drawings for illustrating the embodiment(s) of the present disclosure, the thickness and size of a layer or a structure may be enlarged. However, it should understood that, in the case in which a component or element such as a layer, film, area, substrate or the like is referred to be "on" or "under" another component or element, it may be directly on or under the another component or element or a component or element is interposed therebetween.

(3) In case of no conflict, features in one embodiment or in different embodiments can be combined.

The foregoing are merely specific embodiments of the invention, but not limitative to the protection scope of the invention. Within the technical scope disclosed by the present disclosure, any alternations or replacements which can be readily envisaged by one skilled in the art shall be within the protection scope of the present disclosure. Therefore, the protection scope of the invention shall be defined by the accompanying claims.

What is claimed is:

1. An antenna structure, comprising:

a first substrate;

a second substrate;

a dielectric layer disposed between the first substrate and the second substrate;

a plurality of first electrodes disposed at intervals on a side of the first substrate adjacent to the dielectric layer; and a plurality of second electrodes disposed at intervals on a side of the second substrate adjacent to the dielectric layer, a side of the first substrate facing the second substrate comprising a plurality of first recess portions, each of the plurality of first recess portions comprising a first concaved surface dented into the first substrate, the dielectric layer being at least partly disposed in the plurality of first recess portions, wherein the plurality of first electrodes are disposed in one-to-one correspondence with the plurality of first recess portions, and each of the plurality of first electrodes is disposed on the first concaved surface of a corresponding first recess portion;

a side of the second substrate facing the first substrate comprises a plurality of second recess portions each comprising a second concaved surface which is dented into the second substrate;

the dielectric layer is at least partly disposed in the plurality of second recess portions;

the plurality of second recess portions are disposed in one-to-one correspondence with the plurality of first recess portions;

the first substrate further comprises a plurality of first flat portions each connecting adjacent first recess portions, the second substrate further comprises a plurality of second flat portions each connecting adjacent second recess portions, and the plurality of first flat portions and the plurality of second flat portions are configured to seal the plurality of first recess portions and the plurality of second recess portions, respectively.

2. The antenna structure provided according to claim 1, wherein a cross section of the first recess portion comprises a semi-circular shape.

3. The antenna structure according to claim 1, further comprising a plurality of buffer blocks disposed between the first flat portions and the second flat portions.

4. The antenna structure according to claim 1, wherein the plurality of second electrodes are disposed in one-to-one correspondence with the plurality of second flat portions, and each of the plurality of second electrodes is disposed on a corresponding second flat portion.

5. The antenna structure according to claim 4, wherein an orthographic projection of the second concaved surface on the first substrate is fallen within an orthographic projection of the first concaved surface on the first substrate.

6. The antenna structure according to claim 1, wherein a cross section of the second concaved surface comprises a semi-circular shape.

7. The antenna structure according to claim 1, wherein the dielectric layer comprises liquid crystals (LCs).

8. The antenna structure according to claim 1, wherein each of the first substrate and the second substrate is a flexible substrate.

9. The antenna structure according to claim 1, further comprising:

a first control electrode, which is disposed between the first substrate and the first electrode, and is electrically connected to the first electrode; and a second control electrode, which is disposed between the second substrate and the second electrode, and is electrically connected to the second electrode.

10. A manufacturing method of an antenna structure, comprising:

providing a first substrate and a second substrate;

forming a plurality of first recess portions in the first substrate;

forming a plurality of first electrodes at intervals on a side of the first substrate on which the plurality of first recess portions are formed;

forming a plurality of second electrodes at intervals on the second substrate;

disposing the first substrate and the second substrate to be opposite to each other, and interposing a dielectric layer between the first substrate and the second substrate in such a manner that the side of the first substrate on which the plurality of first electrodes are formed is facing the side of the second substrate on which the plurality of second electrodes are formed, and the dielectric layer being at least partly filled in the plurality of first recess portions;

forming a plurality of second recess portions each comprising a second concaved surface which is dented into the second substrate on a side of the second substrate facing the first substrate;

forming a plurality of first flat portions each connecting adjacent first recess portions on the first substrate; and forming a plurality of second flat portions each connecting adjacent second recess portions on the second substrate, wherein the plurality of first electrodes are disposed in one-to-one correspondence with the plurality of first recess portions, and each of the plurality of first electrodes is disposed on the first concaved surface of a corresponding first recess portion;

the dielectric layer is at least partly disposed in the plurality of second recess portions;

the plurality of second recess portions are disposed in one-to-one correspondence with the plurality of first recess portions; and the plurality of first flat portions and the plurality of second flat portions are configured to seal the plurality of first recess portions and the plurality of second recess portions, respectively.

11. A communication device, comprising the antenna structure which comprises:

a first substrate;

a second substrate;

a dielectric layer disposed between the first substrate and the second substrate;

a plurality of first electrodes disposed at intervals on a side of the first substrate adjacent to the dielectric layer; and a plurality of second electrodes disposed at intervals on a side of the second substrate adjacent to the dielectric layer, a side of the first substrate facing the second substrate comprising a plurality of first recess portions, each of the plurality of first recess portions comprising a first concaved surface dented into the first substrate, the dielectric layer being at least partly disposed in the plurality of first recess portions, wherein the plurality of first electrodes are disposed in one-to-one correspondence with the plurality of first recess portions, and each of the plurality of first electrodes is disposed on the first concaved surface of a corresponding first recess portion;

a side of the second substrate facing the first substrate comprises a plurality of second recess portions each comprising a second concaved surface which is dented into the second substrate;

the dielectric layer is at least partly disposed in the plurality of second recess portions;

the plurality of second recess portions are disposed in one-to-one correspondence with the plurality of first recess portions;

the first substrate further comprises a plurality of first flat portions each connecting adjacent first recess portions;

the second substrate further comprises a plurality of second flat portions each connecting adjacent second recess portions; and the plurality of first flat portions and the plurality of second flat portions are configured to seal the plurality of first recess portions and the plurality of second recess portions, respectively.

* * * * *